US009426573B2

(12) United States Patent
Neufeld et al.

(10) Patent No.: US 9,426,573 B2
(45) Date of Patent: Aug. 23, 2016

(54) SOUND FIELD ENCODER

(71) Applicant: QNX Software Systems Limited, Kanata (CA)

(72) Inventors: Leona Arlene Neufeld, Vancouver (CA); Phillip Alan Hetherington, Port Moody (CA)

(73) Assignee: 2236008 Ontario Inc., Waterloo, Ontario ( * ) Notice: Subject to any disclaimer, the term of this patent is extended or adjusted under 35 U.S.C. 154(b) by 323 days.

(21) Appl. No.: 13/753,236

(22) Filed: Jan. 29, 2013

(65) Prior Publication Data

US 2014/0211950 A1 Jul. 31, 2014

(51) Int. Cl.
*H04R 5/027* (2006.01)
*H04R 5/04* (2006.01)

(52) U.S. Cl.
CPC ..... *H04R 5/027* (2013.01); *H04R 5/04* (2013.01); *H04R 2499/11* (2013.01)

(58) Field of Classification Search
CPC ..... G06F 3/165; G06F 1/1694; G06F 2200/1614; G06F 2200/1637; G06F 3/16; G06F 3/162; H04R 2499/11; H04R 2499/15; H04R 3/005; H04R 5/04; H04R 2420/03; H04R 2201/401; H04R 2420/01; H04S 7/303; H04M 1/6041; H04M 1/0202
USPC ..... 381/22, 23, 58, 334, 91, 123, 119, 92; 379/433.03; 455/414.4, 575.1; 700/13
See application file for complete search history.

(56) References Cited

U.S. PATENT DOCUMENTS

| | | | | |
|---|---|---|---|---|
| 6,882,335 | B2 * | 4/2005 | Saarinen | G06F 1/1605 345/156 |
| 8,189,818 | B2 * | 5/2012 | Takahashi | H04R 1/406 345/156 |
| 8,243,961 | B1 * | 8/2012 | Morrill | 381/123 |
| 8,797,265 | B2 * | 8/2014 | Silvester | G06F 1/1626 345/158 |
| 8,879,761 | B2 * | 11/2014 | Johnson et al. | 381/306 |
| 9,066,169 | B2 * | 6/2015 | Dunn | H04R 3/005 |
| 2010/0008523 | A1 * | 1/2010 | Demuynck et al. | 381/182 |

(Continued)

FOREIGN PATENT DOCUMENTS

| | | | |
|---|---|---|---|
| EP | 2428864 | A2 | 3/2012 |
| WO | WO 2009/109217 | A1 | 9/2009 |
| WO | WO 2012/061149 | A1 | 5/2012 |

OTHER PUBLICATIONS

Extended European Search Report, dated Jul. 17, 2013, pp. 1-7, European Patent Application No. 13153112.1, European Patent Office, Munich Germany.

(Continued)

*Primary Examiner* — Vivian Chin
*Assistant Examiner* — Jason R Kurr
(74) *Attorney, Agent, or Firm* — Brinks Gilson & Lione

(57) ABSTRACT

In a system and method for encoding a sound field the orientation of a computing device may be detected. Several orientation indications may be used to detect the computing device orientation. The detected orientation may be relative to a sound field that is a spatial representation of an audible environment associated with the computing device. Microphones associated with the computing device may be selected in order to receive the sound field based on the detected orientation. The received sound field may be processed and encoded with associated descriptive information.

24 Claims, 10 Drawing Sheets

(56) References Cited

U.S. PATENT DOCUMENTS

| | | | | |
|---|---|---|---|---|
| 2010/0056227 | A1 | 3/2010 | Hayakawa et al. | |
| 2011/0002487 | A1* | 1/2011 | Panther et al. | 381/300 |
| 2012/0128175 | A1* | 5/2012 | Visser et al. | 381/92 |
| 2013/0147923 | A1* | 6/2013 | Zhou et al. | 348/47 |
| 2013/0163794 | A1* | 6/2013 | Groves et al. | 381/303 |
| 2013/0177168 | A1* | 7/2013 | Inha et al. | 381/92 |
| 2014/0086415 | A1* | 3/2014 | Sim | G06F 1/1688 381/17 |
| 2015/0023533 | A1 | 1/2015 | Johnson et al. | |
| 2015/0078606 | A1* | 3/2015 | Zhang et al. | 381/365 |
| 2015/0178038 | A1* | 6/2015 | Yliaho | H04R 3/005 455/566 |

OTHER PUBLICATIONS

Non-Final Office Action, dated Mar. 31, 2015, pp. 1-7, U.S. Appl. No. 13/753,229, US Patent and Trademark Office, Alexandria, VA.

* cited by examiner

SOUND FIELD ENCODER

BACKGROUND

1. Technical Field

The present disclosure relates to the field of sound field encoding. In particular, to a system and method for encoding a sound field received by two or more microphones.

2. Related Art

Stereo and multichannel microphone configurations may be used to receive and/or transmit a sound field that is a spatial representation of an audible environment associated with the microphones. The received audio signals may be used to reproduce the sound field using audio transducers.

Many computing devices may have multiple integrated microphones used for recording an audible environment associated with the computing device and communicating with other users. Computing devices typically use multiple microphones to improve noise performance with noise suppression processes. The noise suppression processes may result in the reduction or loss of spatial information. In many cases the noise suppression processing may result in a single, or mono, output signal that has no spatial information.

BRIEF DESCRIPTION OF DRAWINGS

The system and method may be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

Other systems, methods, features and advantages will be, or will become, apparent to one with skill in the art upon examination of the following figures and detailed description. It is intended that all such additional systems, methods, features and advantages be included with this description, be within the scope of the invention, and be protected by the following claims.

DETAILED DESCRIPTION

In a system and method for encoding a sound field the orientation of a computing device may be detected. Several orientation indications may be used to detect the computing device orientation. The detected orientation may be relative to a sound field that is a spatial representation of an audible environment associated with the computing device. Microphones associated with the computing device may be selected in order to receive the sound field based on the detected orientation. The received sound field may be processed and encoded with associated descriptive information.

Figure 1B:
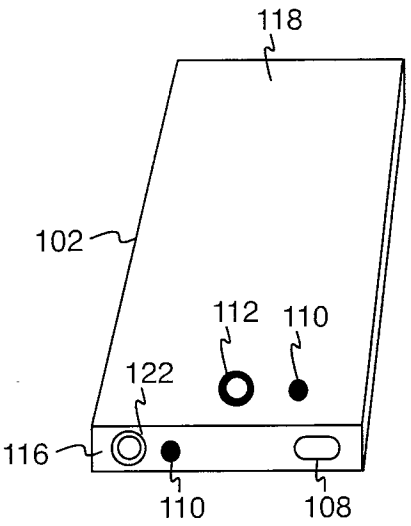
FIGS. 1A-1C are schematic representations of a computing device showing example microphone and audio transducer placements.
Figure 1A:
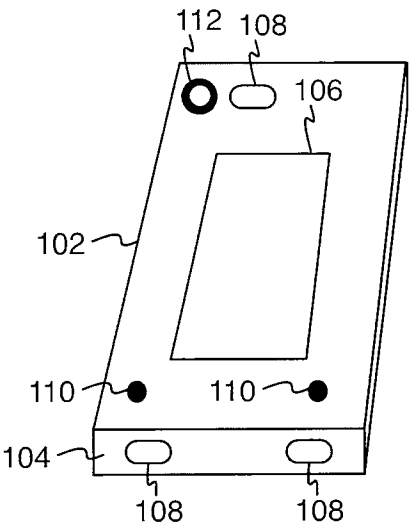
Figure 1C:
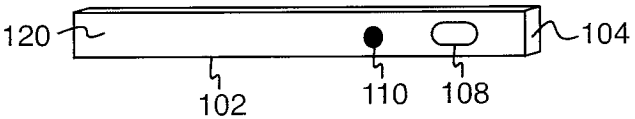

FIGS. 1A-1C are schematic representations of a computing device showing example microphone and audio transducer placements. FIG. 1A shows a front surface view of the computing device 102 with example microphone 110 and audio transducer 108 placements. Audio transducers 108 may also be referred to as audio speakers. The microphones 110 may be located on the front surface of the computing device 102. The audio transducers 108 may be located on the bottom surface 104 and the front surface. The computing device 102 may include one or more components including a display screen 106 and a camera 112 located on the front surface. FIG. 1B shows a back surface view of the computing device 102 with example microphone 110 and audio transducer 108 placements. The microphones 110 may be located on the back surface 118 and the top surface 116 of the computing device 102. The audio transducer 108 may be located on the top surface 116 of the computing device 102. The computing device 102 may include one or more components including a camera 112 located on the back surface 118 of the computing device 102 and a headphone connector 122 located on the top surface 116 of the computing device 102. FIG. 1C shows a side surface view of the computing device 102 with example microphone 110 and audio transducer 108 placements. The microphone 110 and the audio transducer 108 may be located on the side surface 120 of the computing device 102. The number and location of the microphones 110, the audio transducers 108 and the other components of the computing device 102 shown in FIGS. 1A-1C are example locations. The computing device 102 may include more or less microphones 110, audio transducers 108 and other components located in any position associated with the computing device 102. Microphones 110 and audio transducers 108 may be associated with the computing device 102 using a wired or wireless connection (not shown). For example, many headsets that plug into the headphone connector 116 may include microphones 110 or audio transducers 108.

Figure 2:
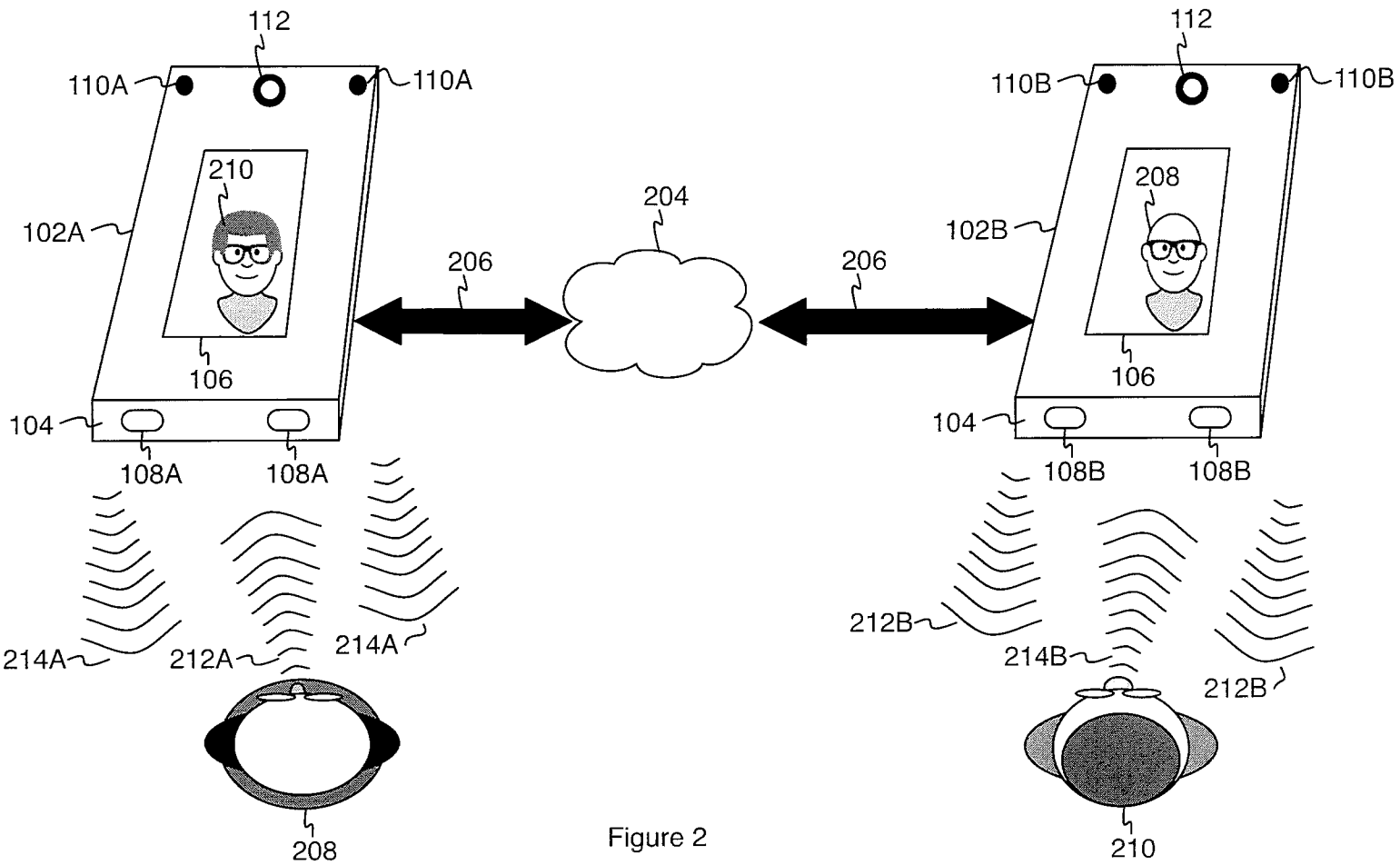
FIG. 2 is a schematic representation of a first user communicating with a second user through the use of a first computing device and a second computing device.

FIG. 2 is a schematic representation of a first user communicating with a second user through the use of a first computing device and a second computing device. The first user 208 communicates with the second user 210 where the first user 208 utilizes the first computing device 102A connected via a communication network 204 to the second computing device 102B utilized by the second user 210. The communication network 204 may be a wide area network (WAN), a local area network (LAN), a cellular network, the Internet or any other type of communications network. The first computing device 102A and the second computing device 102B may connect 206 to the communication network 204 using a wireless or wired communications protocol. FIG. 2 shows the first computing device 102A oriented toward the first user 208 so that the front surface is pointed towards the face of the first user 208. The first user 208 can view the display screen 106 and the camera 112 may capture an image of the first user 208. Two microphones 110A may be located on the front surface of the first computing device 102A where the microphones 110A may receive, or capture, a sound field 212A relative to the first user 208. The sound field 212A associated with two microphones 110A may also be referred to as a stereo sound field 212A. More than two microphones 110A may capture a multichannel sound field 212A. The orientation of first computing device 102A relative to the first user 208 may capture a stereo, or horizontal, sound field.

The two audio transducers 108A on the bottom surface 104 of the first computing device 102A may reproduce a stereo, or horizontal, sound field 214A with the shown orientation relative to the first user 208. More than two audio transducers 108A may reproduce a multichannel sound field 214A. The second user 210 and the second computing device 102B are shown to be in the same orientation as the first user 208 and the first computing device 102A. The first computing device 102A and the second computing device 102B may not have the same arrangement of microphones 110, audio transducers 108 or other components as shown in FIG. 2.

The first user 208 communicates to the second user 210 whereby the sound field 212A received by the microphones 110A on the first computing device 102A is encoded and transmitted to the second computing device 102B. The second computing device 102B reproduces the received encoding of the sound field 212B with the audio transducers 108B. The microphones 110A on the first computing device 102 have similar horizontal orientation to the first user 208 as the audio transducers 108B on the second computing device 102B have to the second user 210 whereby the stereo sound field 212B is reproduced by the audio transducers 108B. The second user 210 may communicate the stereo sound field 214B to the first user 208 in a similar fashion to that of the sound field 212A since orientation of the microphones 110A and 110B, audio transducers 108A and 108B and first user 208 and second user 210 are similar.

FIGS. 1 through 7 have a reference numbering scheme where microphones 110 references to any of the microphones 110A, 110B, 110C, 110CC, 110D, etc. while 110A is limited to the instance labeled as such. The reference numbering scheme is similar for the computing devices 102 and the audio transducers 108. The first user 208 and the second user 210 may be referenced as the user 208.

Figure 3:
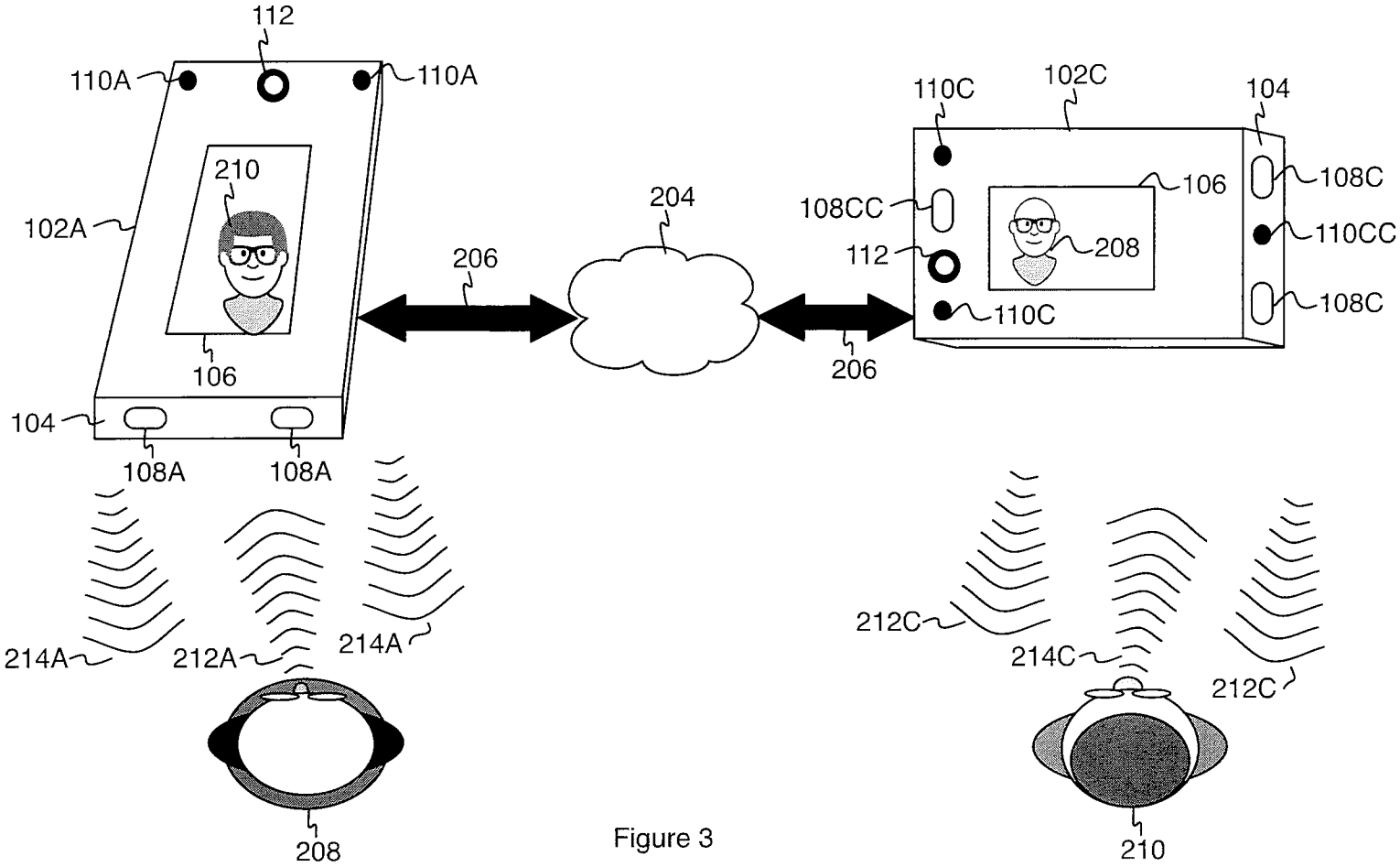
FIG. 3 is a schematic representation of the first user communicating with the second user where the second computing device microphones and audio transducers are oriented perpendicular to the sound field associated with the second user.

FIG. 3 is a schematic representation of the first user communicating with the second user where the second computing device microphones and audio transducers are oriented substantially perpendicular to the sound field associated with the second user. The first user 208 and the first computing device 102A in FIG. 3 are orientated the same as that shown in FIG. 2. The second user 210 and the second computing device 102C are orientated so that the microphones 110C and the audio transducers 108C are substantially perpendicular to the sound fields 212C and 214C associated with the second user 210. An alternative way of describing the computing device orientation relative to the user position is that the first computing device 102A is in a portrait orientation relative to the first user 208 and the second computing device 102C is in a landscape orientation relative to the second user 210. The encoded sound field 212A received by the second computing device 102C may be reproduced in the same fashion described in FIG. 2 without regard to the orientation of the second user 210. The reproduced sound field 212C may not create a stereo, or horizontal, sound field 212C because of the second computing device 102C orientation. A system and method for reproducing the sound field 212C may detect the orientation of second computing device 102C and process the received sound field 212A accordingly. For example, the second computing device 102C may process the received sound field 212A to produce a mono output using the audio transducers 108C since the second user 210 will not be able to perceive a stereo sound field 212C with the orientation of the second computing device 102C. The processed mono output may provide improved signal to noise ratio (SNR). Alternatively two or more different audio transducers 108 may be selected to reproduce the sound field 212C. For example, if the second audio device 102C has an audio transducer 108CC horizontally opposite the audio transducer 108C on the bottom surface 104, a different audio transducer 108 selection may direct the reproduction of the sound field 212C to the audio transducer 108CC and the audio transducer 108C creating a stereo, or horizontal, sound field 212C relative to the second user 210.

The encoded sound field 212A communicated from the first computing device 102A may include the received audio signals from the microphones 110A and associated descriptive information. The associated descriptive information may include a number of received audio channels, a physical location of the microphones, a computing device 102A identification number, a computing device 102A orientation, video synchronization information and any other associated information. The second computing device 102C may utilize the associated descriptive information to select which of the two or more audio transducers 108C are utilized to reproduce the sound field 212C. The associated descriptive information may be used to process the received encoded sound field 212A. For example, the associated descriptive information may improve the mixing of multiple audio channels to a fewer number of audio channels. Similar descriptive information may also be associated with the encoded sound field 214C.

The second user 210 in FIG. 3 and the second computing device 102C are orientated where the microphones 110C are perpendicular to the sound field 214C associated with the second user 210. The microphones 110C will capture a vertical sound field in the shown second computing device 102C orientation. The system and method for encoding the sound field 214C may detect the orientation of second computing device 102C and process the captured sound field 214C accordingly. For example, the second computing device 102C may process the captured sound field 214C to produce a mono sound field 214C since the first user 208 will not be able to perceive a stereo sound field 214A with the orientation of the second computing device 102C. The mono sound field 214C may provide improved signal to noise ratio (SNR). Alternatively two or more different microphones 110 may be selected to receive the sound field 214C. For example, if the second audio device 102C has a microphone 110CC horizontally opposite the microphones 110C on the front surface, a different microphone 110 selection may direct the capture of the sound field 214C to the microphones 110C and the microphone 110CC located on the bottom surface 104 capturing a stereo, or horizontal, sound field 214C relative to the second user 210.

Microphones 110 and audio transducers 108 may be selected responsive to one or more indications of orientation of the computing device 102. The one or more indications of orientation may be detected relative to the desired sound fields 212 and 214 associated with the computing device 102. The processing of the received and reproduced sound fields 212 and 214 may be performed responsive to the one or more indications of orientation of the computing device 102. The indications of orientation of the computing device 102 may include one or more of a sensor reading, an active component, an operating mode and a relative position of a user 208 interacting with the computing device 102. The sensor reading may be generated by one of more of a magnetometer, an accelerometer, a proximity sensor, a gravity sensor, a gyroscope and a rotational vector sensor associated with the computing device 102. The active component may include one or more of a front facing camera 112, a back facing camera 112 or a remote camera 112. The operating mode may include one or more of a software application and an orientation lock setting. The relative position of a user 208 interacting with the computing device 102 may include facial analysis or head tracking.

FIG. 3 shows the first user 208 and the second user 210 using a videoconference software application. The first computing device 102A shows an image of the second user 210 on the display screen 106. The second computing device 102C shows an image of the first user 208 on the display screen 106. The videoconference software application may utilize one or more indications of orientation to determine how to display the image on the display screen 106. The selection of which microphones 110 and audio transducers 108 are utilized may be responsive to how the image is oriented on the display screen 106. The orientation detection may select orientation indications relative to the video conferencing application instead of the computing device 102 physical orientation. For example, a user 208 hanging upside down while holding the computing device 102A in a portrait orientation may use facial recognition software to orient the sound field 212A instead of a gyroscope sensor.

Figure 4:
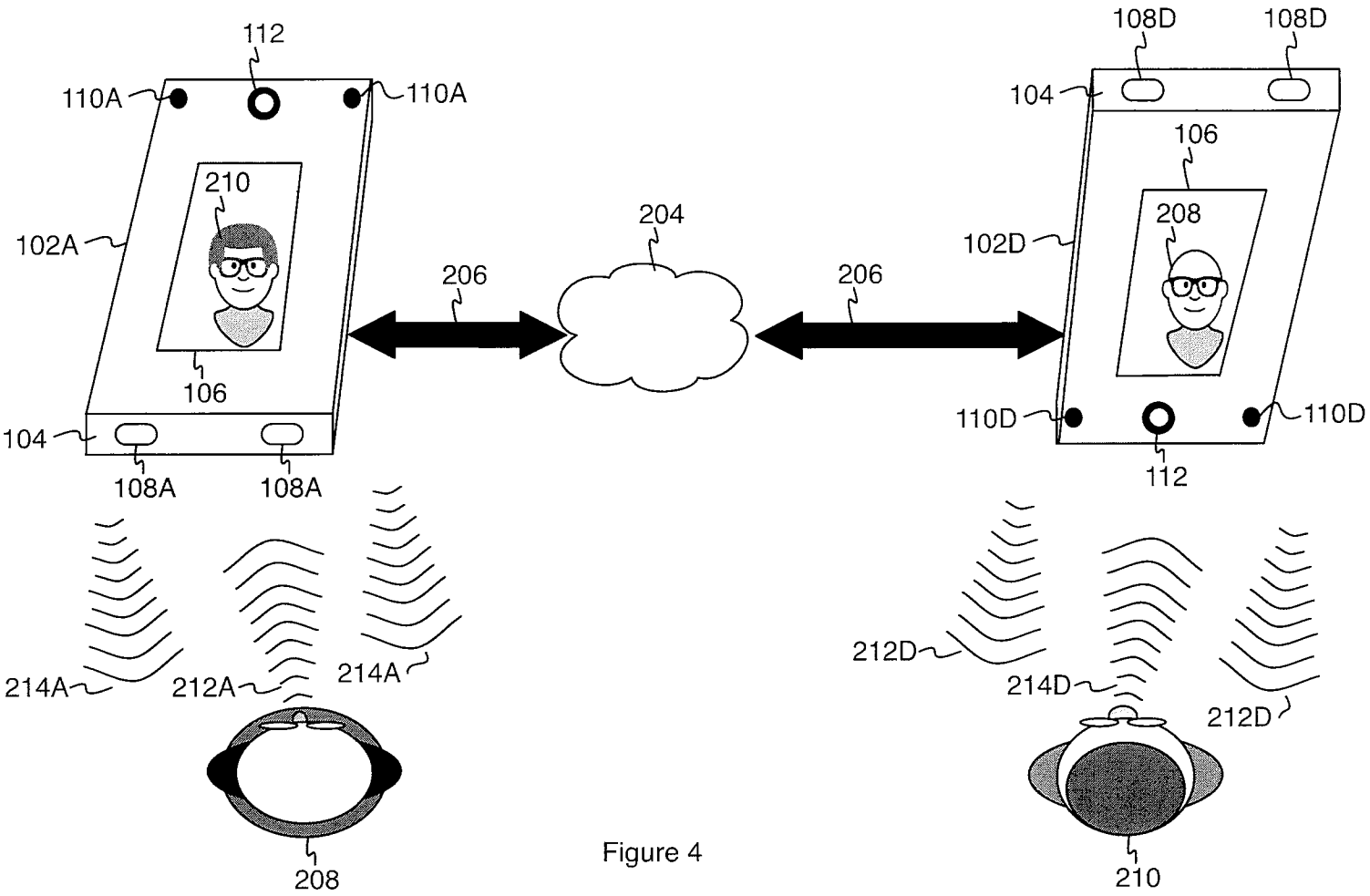
FIG. 4 is a schematic representation of the first user communicating with the second user where the second computing devices microphones and audio transducers are inverted in orientation to the sound field associated with the second user.

FIG. 4 is a schematic representation of the first user communicating with the second user where the second computing devices microphones and audio transducers are inverted in orientation to the sound field associated with the second user. FIG. 4 shows the second user 210 interacting with the second computing device 102D that is in an inverted orientation relative to the second user 210. The front surface of the second computing device 102D is directed toward the second user 210 and the bottom surface 104 is aligned with the top of the head of the second user 210. The sound field 214D received by the microphones 110D will be inverted relative to the orientation of the first computing device 102A and the first user 208. The received sound field 214D may be processed before encoding to compensate for the inverted orientation. The processing may include swapping, or switching, the two received microphone 110D channels that represent the sound field 214D. An alternative approach may have the first computing device 102A process the encoded sound field 214D to compensate for the inverted orientation of the second computing device 102D by swapping, or switching, the audio channels. The first computing device 102A may perform the processing responsive to the associated descriptive information.

The inverted orientation of the audio transducers 108D on the second computing devices 102D may result in an inverted reproduction of the sound field 212D. The inverted reproduction of the sound field 212D may be corrected in a similar fashion to that used for the microphones 110D described above with reference to FIG. 4. The inverted sound field 212D may be adjusted by processing the received sound field 212A in the first computing device 102A or through processing the received sound field 212A in the second computing device 102D.

Figure 5:
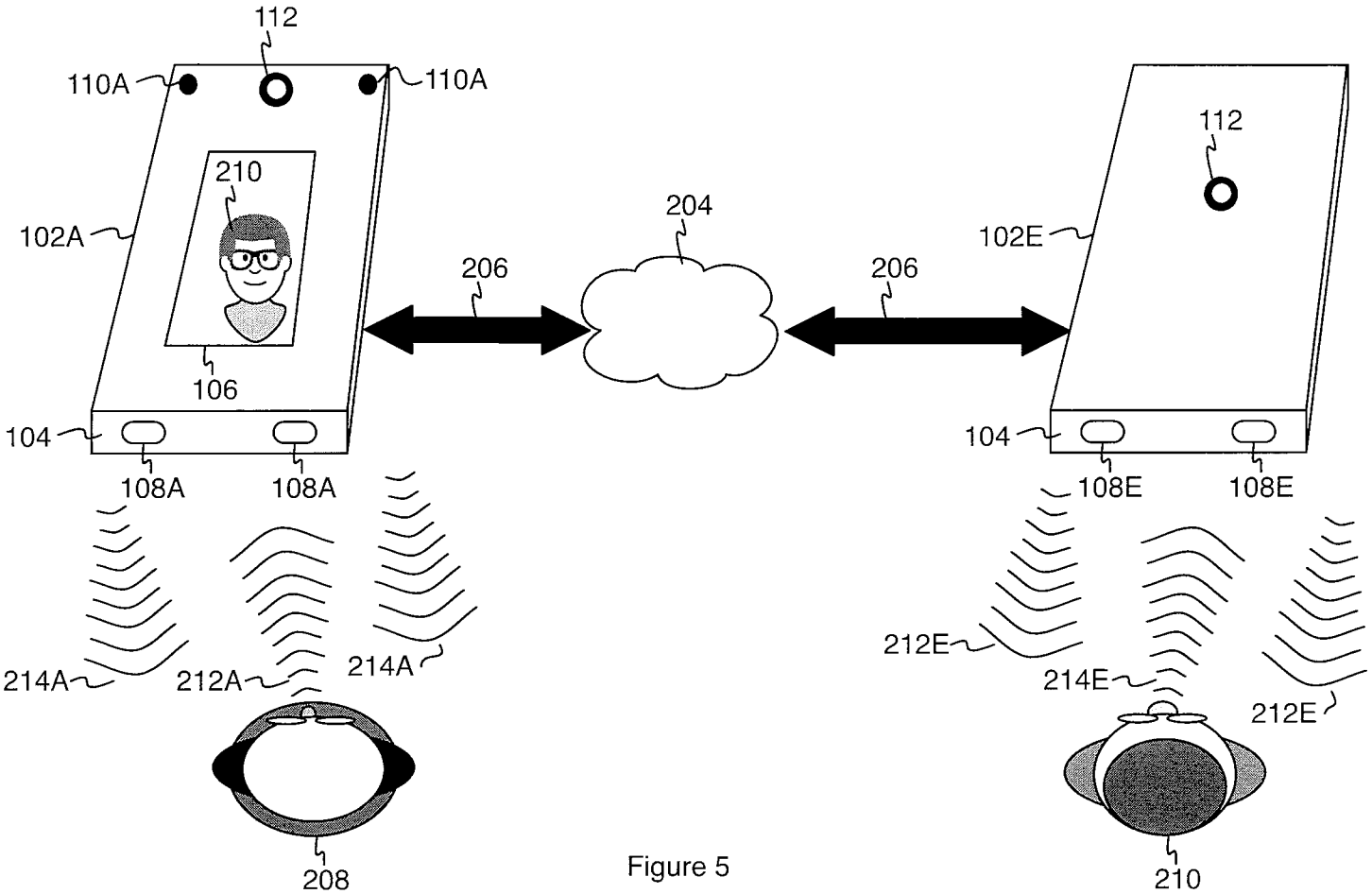
FIG. 5 is a schematic representation of the first user communicating with the second user where the second computing device has the back surface of the second computing device orientated toward the second user.

FIG. 5 is a schematic representation of the first user communicating with the second user where the second computing device has the back surface of the second computing device orientated toward the second user. The second computing device 102E is shown with the back surface oriented towards the second user 210. The back surface orientation shown in FIG. 5 results in the sound field 214E received by the microphones 110, not shown, and the sound field 212E reproduced by the audio transducers 108E to be reversed. The microphones 110 associated with the second computing device 102E may be located in the same position as the second computing device 102D. The reversing of the sound fields 212E and 214E may be adjusted in a similar fashion to that described above with reference to FIG. 4. Additional selection and processing of the microphones (not shown) and audio transducers 108E on the second computing device 102E may be performed with a different layout of microphones 110 and audio transducers 108.

Figure 6:
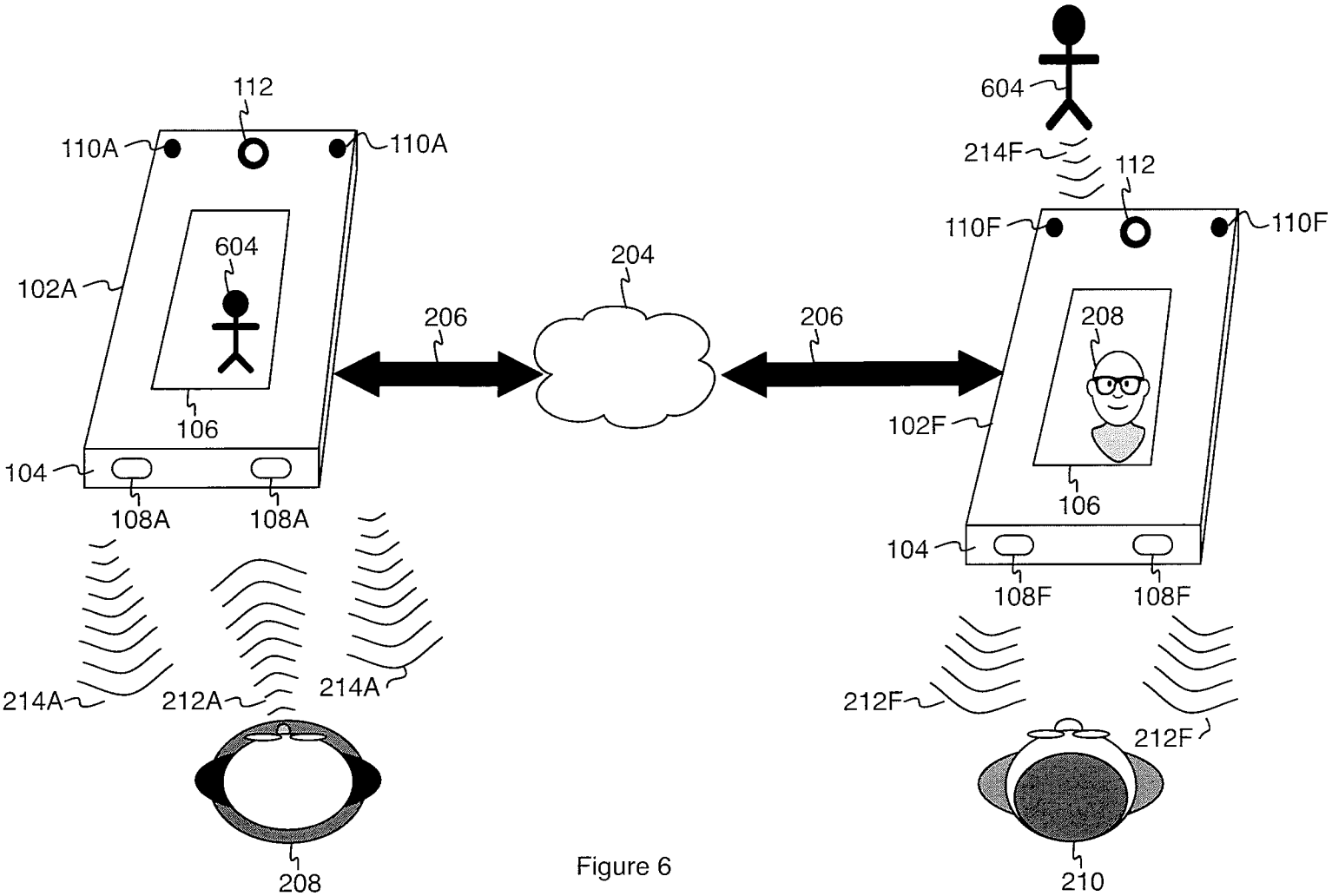
FIG. 6 is a schematic representation of the first user communicating with the second user where the second user has the second computing device oriented towards a third user.

FIG. 6 is a schematic representation of the first user communicating with the second user where the second user has the second computing device oriented towards a third user. The front surface of the second computing device 102F is shown oriented toward the second user 210 with the back camera 112, not shown, on the back surface oriented towards a third user 604. A video conferencing application displays the third user 604 on the first computing device 102A and the first user 208 on the second computing device 102F. The microphones 110F capture the sound field 214F associated with the third user 604 resulting in an inverted sound field 214A relative to the first computing device 102A. An approach similar to that described in FIG. 4 for adjusting the inverted sound field 214D may be applied.

Figure 7:
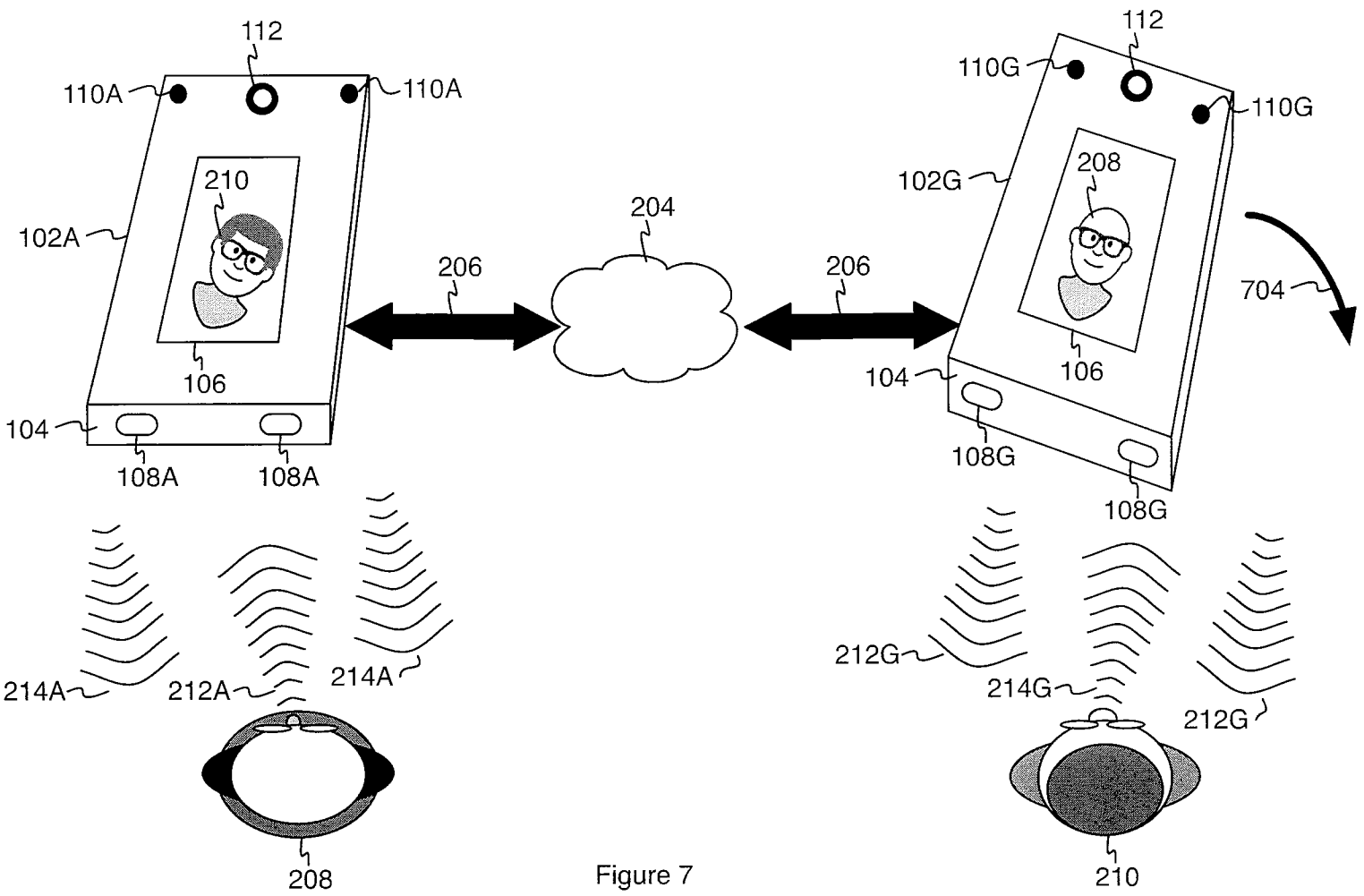
FIG. 7 is a schematic representation of the first user communicating with the second user where the second computing devices microphones and audio transducers are changing orientation relative to the sound field associated with the second user.

FIG. 7 is a schematic representation of the first user communicating with the second user where the second computing device microphones and audio transducers are changing orientation relative to the sound field 214G associated with the second user. The second computing device 102G is shown with a changing orientation 704 relative to the second user 210. The changing orientation 704 of the second computing device 102G may be interpreted as starting in a portrait orientation and transitioning to a landscape orientation. The description above referencing FIG. 2 describes how the microphones 110G may be selected and the sound field 214G may be encoded when the second computing device 102G is in a portrait orientation. The description above referencing FIG. 2 also describes how to process the sound field 212G and select audio transducers 108G. The description above referencing FIG. 3 describes how the microphones 110G may be selected and the sound field 214G may be encoded when the second computing device 102G is in a landscape orientation. The description above referencing FIG. 3 also describes how to process the sound field 212G and select audio transducers 108G. When the second computing device 102G is oriented partway between portrait and landscape orientation the sound fields 212G and 214G may be processed as portrait or landscape as described above. One approach processes, or mixes, the orientation of the sound fields 212G and 214G in a way that creates a smooth transition between a portrait orientation and a landscape orientation. For example, the second computing device 102G in portrait orientation may encode two microphones 110G resulting in a stereo, or horizontal, sound field 214G. When the second computing device 102G is changed to a landscape orientation, the two microphones 110G may be processed to encode a mono sound field 214G. The first user 208 may audibly detect a noticeable change in the sound field 214A as it switches from stereo to mono. An alternative approach that may mitigate the noticeable change in the sound field 214A during a transition may mix, or process, over time the sound field 214G in the first orientation and the sound field 214G in the second orientation. The first user 208 may perceive a smooth transition between the stereo portrait orientation to the mono landscape orientation. For example, variable ratio, or pan-law, mixing between the first orientation and the second orientation may allow the first user 208 to perceive the sound field 214A to have a constant loudness level during the transition. Pan-law mixing applies a sine weighting. Mixing the received sound field 214G between the first orientation and the second orientation may comprise any number of selected microphone 110 and a changing number of microphones 110.

In another example, the second computing device 102G in portrait orientation may reproduce a stereo, or horizontal, sound field 212G using two audio transducers 108G. When the second computing device 102G is changed to a landscape orientation, the two audio transducers 108G may be processed to reproduce a mono sound field 212G. The second user 210 may detect a noticeable change in the sound field 212G as it switches from stereo to mono. One approach that may mitigate the noticeable change in the sound field 212G during a transition may mix, or process, the sound field 212A over time when transitioning from the first orientation to the second orientation. The second user 210 may perceive a smooth transition between the stereo portrait orientation to the mono landscape orientation. For example, pan-law mixing between the first orientation and the second orientation may allow the second user 210 to perceive the sound field 212G to have a constant loudness level during the transition. Mixing the received sound field 212A between the first orientation and the second orientation may comprise any number of selected audio transducers 108G and a changing number of audio transducers 108G.

The computing devices 102A-G shown in FIGS. 2-7 may be similar to any computing device 102 as described referencing FIG. 1. The associated microphone 110A-G and 110CC may be similar to any microphone 110 as described referencing FIG. 1. The associated audio transducers 108A-G and 108CC may be similar to any audio transducer 108 as described referencing FIG. 1. The sound fields 212A-G and 214A-G referenced and described in FIGS. 2-7 may be referenced as sound field 212. The users 208 and 210 referenced and described in FIGS. 2-7 may be referenced as user 208.

Figure 8:
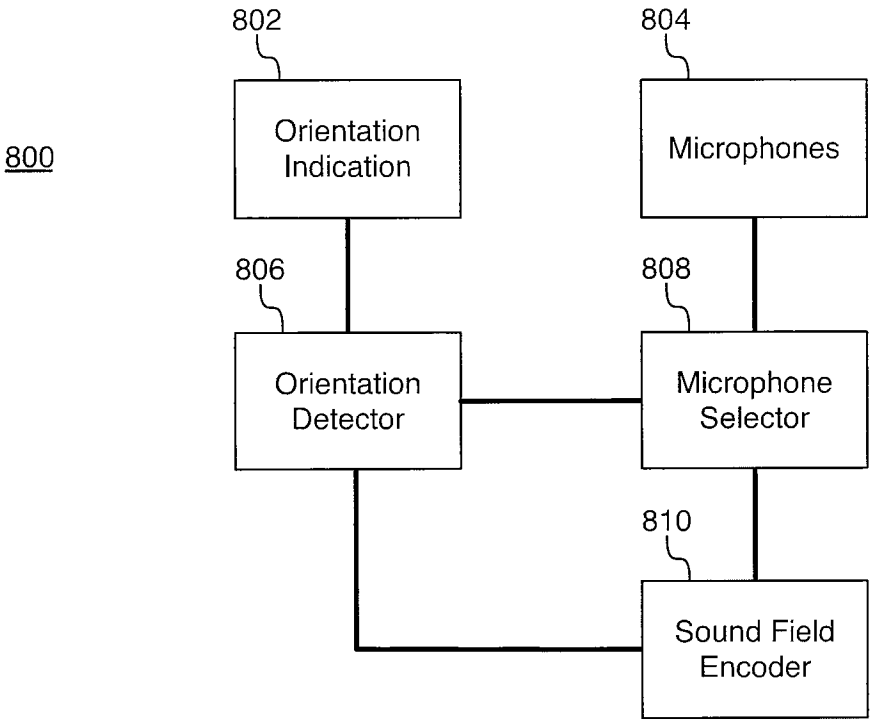
FIG. 8 is a schematic representation of a system for encoding a sound field.

FIG. 8 is a schematic representation of a system for encoding a sound field. The example system 800 may comprise functional modules for orientation indication 802, orientation detector 806, microphone selector 808, sound field encoder 810 and may also comprise physical components for orientation indications 802 and microphones 804. The orientation indication 802 may provide one or more indications of device orientation that may include one or more of a sensor reading, an active component, an operating mode and a relative position of a user 208 interacting with the computing device 102. The sensor reading may be generated by one of more of a magnetometer, an accelerometer, a proximity sensor, a gravity sensor, a gyroscope and a rotational vector sensor associated with the computing device 102. The active component may include one or more of a front facing camera 112, a back facing camera 112 or a remote camera 112. The operating mode may include one or more of a software application and an orientation lock setting. The relative position of a user 208 interacting with the computing device 102 may include facial analysis or head tracking. The orientation detector 806 may be responsive to one or more orientation indications 802 to detect the orientation of the computing device 102.

Two or more microphones 804 may be associated with the computing device 102. The two or more microphones 804 may receive the sound field where the sound field comprises a spatial representation of an audible environment associated with the computing device 102. The microphone selector 808 selects one or more microphones 804 associated with the computing device responsive to the orientation detector 806 of the computing device 102. The microphone selector 808 may select microphones 804 that may receive the sound field 212 associated with the orientation detector 806. The sound field encoder 810 processes the sound field 212 received from the microphone selector 808. The sound field encoder 810 may process the sound field by one or more of the following upmixing, downmixing and filtering. The sound field encoder 801 may associate descriptive information that may include the number of audio channels, the physical location of the selected microphones, a device identification number, device orientation, video synchronization information and other information.

Figure 9:
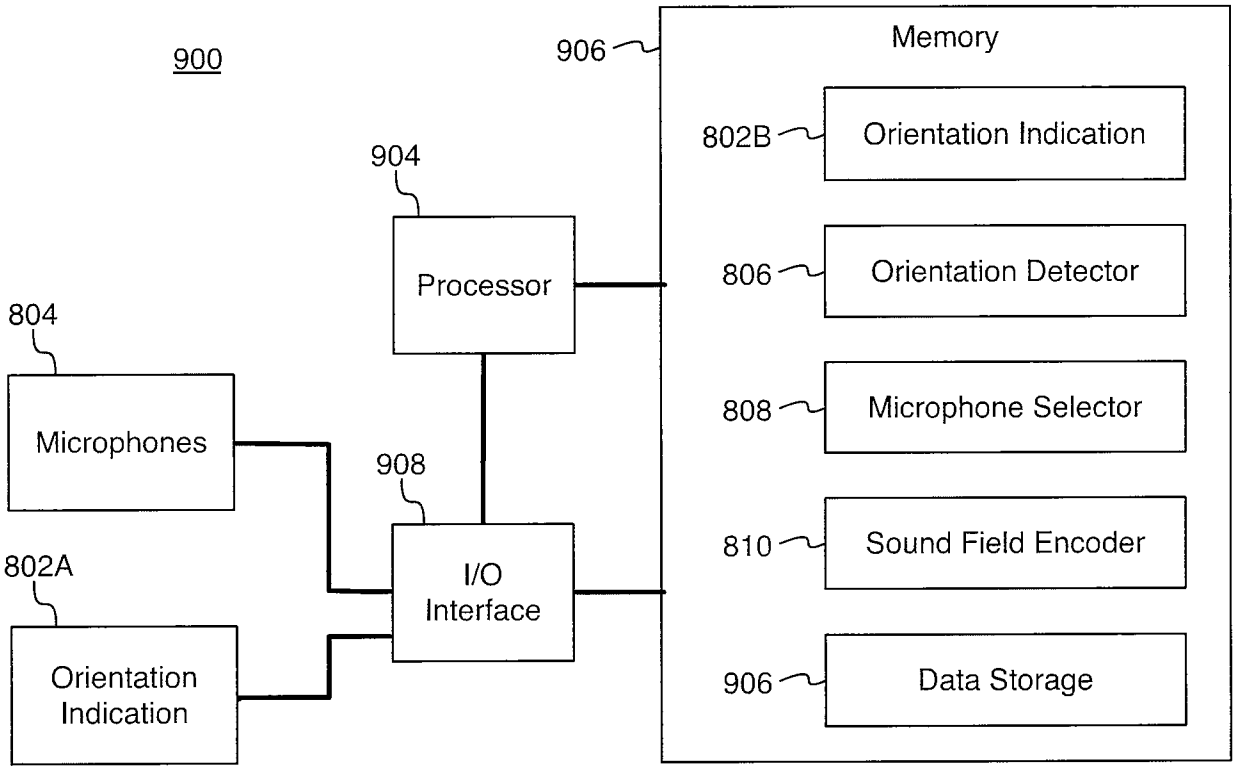
FIG. 9 is a further schematic representation of a system for encoding a sound field.

FIG. 9 is a further schematic representation of a system for encoding a sound field. The system 900 comprises a processor 904, memory 906 (the contents of which are accessible by the processor 904), the microphones 804, the orientation indication 802A and 802B and an I/O interface 908. The orientation indication 802A may comprise a hardware interrupt associated with a sensor output. The orientation indication 802B may be an indication associated with a software module. Both orientation indication 802A and 802B provide similar functionality to that described in the orientation indication 802 shown in FIG. 8. The memory 906 may store instructions which when executed using the processor 904 may cause the system 900 to render the functionality associated with the orientation indication module 802B, the orientation detection module 806, the microphone selector module 808 and the sound field encoder module 810 as described herein. In addition, data structures, temporary variables and other information may store data in data storage 906.

The processor 904 may comprise a single processor or multiple processors that may be disposed on a single chip, on multiple devices or distributed over more that one system. The processor 904 may be hardware that executes computer executable instructions or computer code embodied in the memory 906 or in other memory to perform one or more features of the system. The processor 904 may include a general purpose processor, a central processing unit (CPU), a graphics processing unit (GPU), an application specific integrated circuit (ASIC), a digital signal processor (DSP), a field programmable gate array (FPGA), a digital circuit, an analog circuit, a microcontroller, any other type of processor, or any combination thereof.

The memory 906 may comprise a device for storing and retrieving data, processor executable instructions, or any combination thereof. The memory 906 may include non-volatile and/or volatile memory, such as a random access memory (RAM), a read-only memory (ROM), an erasable programmable read-only memory (EPROM), or a flash memory. The memory 906 may comprise a single device or multiple devices that may be disposed on one or more dedicated memory devices or on a processor or other similar device. Alternatively or in addition, the memory 906 may include an optical, magnetic (hard-drive) or any other form of data storage device.

The memory 906 may store computer code, such as the orientation indication module 802, the orientation detection module 806, the microphone selector module 808, and sound field encoder module 810 as described herein. The computer code may include instructions executable with the processor 904. The computer code may be written in any computer language, such as C, C++, assembly language, channel program code, and/or any combination of computer languages. The memory 906 may store information in data structures in the data storage 906.

The I/O interface 908 may be used to connect devices such as, for example, microphones 804, orientation indications 802, and to other components of the system 900.

All of the disclosure, regardless of the particular implementation described, is exemplary in nature, rather than limiting. The systems 800 and 900 may include more, fewer, or different components than illustrated in FIGS. 8 and 9. Furthermore, each one of the components of systems 800 and 900 may include more, fewer, or different elements than is illustrated in FIGS. 8 and 9. Flags, data, databases, tables, entities, and other data structures may be separately stored and managed, may be incorporated into a single memory or database, may be distributed, or may be logically and physically organized in many different ways. The components may operate independently or be part of a same program or hardware. The components may be resident on separate hardware, such as separate removable circuit boards, or share common hardware, such as a same memory and processor for implementing instructions from the memory. Programs may be parts of a single program, separate programs, or distributed across several memories and processors.

The functions, acts or tasks illustrated in the figures or described may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing, distributed processing, and/or any other type of processing. In one embodiment, the instructions are stored on a removable media device for reading by local or remote systems. In other embodiments, the logic or instructions are stored in a remote location for transfer through a computer network or over telephone lines. In yet other embodiments, the logic or instructions may be stored within a given computer such as, for example, a CPU.

Figure 10:
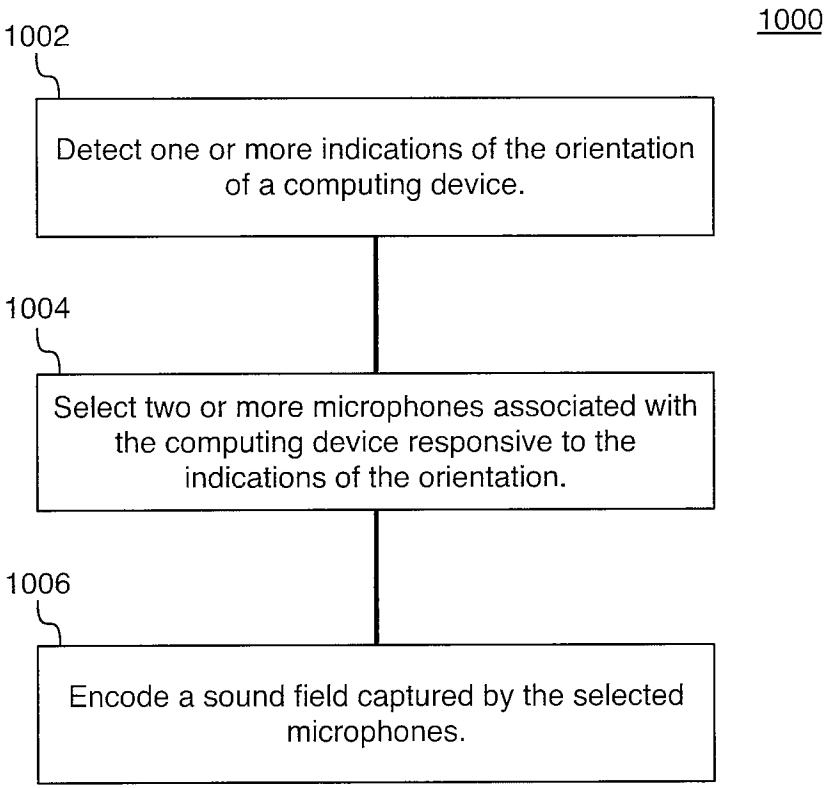
FIG. 10 is flow diagram representing a method for encoding a sound field.

FIG. 10 is flow diagram representing a method for encoding a sound field. The method 1000 may be, for example, implemented using either of the systems 800 and 900 described herein with reference to FIGS. 8 and 9. The method 1000 includes the act of detecting one or more indications of the orientation of the computing device 1002. Detecting one or more indication of the orientation may include one or more of a sensor reading, an active component, an operating mode and a relative position of a user 208 interacting with the computing device 102. Responsive to the indications of orientation, selecting one or more microphones associated with the computing device 1004. The one or more selected microphones may receive the sound field that comprises a spatial representation of an audible environment associated with the computing device. Encoding a sound field captured by the selected microphones 1006. The encoding may associate descriptive information with the received sound field that may include the number of audio channels, the physical location of the selected microphones, a device identification number, device orientation, video synchronization information and other information The method according to the present invention can be implemented by computer executable program instructions stored on a computer-readable storage medium.

While various embodiments of the invention have been described, it will be apparent to those of ordinary skill in the art that many more embodiments and implementations are possible within the scope of the present invention. Accordingly, the invention is not to be restricted except in light of the attached claims and their equivalents.

The invention claimed is:

1. A computer implemented method for encoding a sound field comprising:

detecting one or more indications of the orientation of a first computing device;

selecting one or more microphones from a plurality of microphones that are on sides of the first computing device responsive to the indications of the orientation of the first computing device, the plurality of microphones including at least two microphones on one side of the first computing device; and encoding a sound field received by the selected microphones by associating descriptive information with the sound field indicating the orientation of the first computing device, wherein a second computing device is configured to select audio transducers to reproduce the sound field based on the descriptive information indicating the orientation of the first computing device.

2. The computer implemented method of claim 1, where the one or more indications of the orientation of the first computing device comprises any one or more of a sensor reading, an active component, an operating mode and the relative position of a user interacting with the first computing device.

3. The computer implemented method of claim 2, where a sensor that provides the sensor reading comprises one or more of a magnetometer, an accelerometer, a proximity sensor, a gravity sensor, a gyroscope and a rotational vector sensor.

4. The computer implemented method of claim 2, where the active component comprises one or more of a front facing camera, a back facing camera or a remote camera.

5. The computer implemented method of claim 2, where the operating mode comprises one or more of a software application and an orientation lock setting.

6. The computer implemented method of claim 1, where the sound field comprises a spatial representation of an audible environment associated with the first computing device.

7. The computer implemented method of claim 1, where encoding the sound field comprises processing audio signals received by the selected microphones and associating descriptive information with the audio signals.

8. The computer implemented method of claim 7, where the associated descriptive information with the selected microphones comprises any one or more of a number of selected microphones, a physical location of the selected microphones, a device identification number and video synchronization information.

9. The computer implemented method of claim 7, where the selected microphones comprises two selected microphones associated with a stereo sound field.

10. The computer implemented method of claim 7, where the selected microphones comprises three or more selected microphones associated with a multichannel sound field.

11. The computer implemented method of claim 7, where processing the audio signals received by the selected microphones comprises mixing the audio signals to produce fewer audio signals representing fewer selected microphones.

12. The computer implemented method of claim 1, where encoding the sound field further comprises:

applying variable ratio mixing.

13. A system for encoding a sound field comprising:

an orientation detector to detect one or more indications of the orientation of a first computing device;

a microphone selector to select one or more microphones from a plurality of microphones located on sides of the first computing device responsive to the one or more indications of the orientation of the first computing device; and a sound field encoder to encode a sound field received by the selected microphones through inclusion of descriptive information with the encoded sound field indicative of the orientation of the first computing device, wherein a second computing device is configured to select audio transducers to reproduce the sound field based on the descriptive information indicative of the orientation of the first computing device.

14. The system for encoding a sound field of claim 13, where the one or more indications of the orientation of the first computing device comprises any one or more of a sensor reading, an active component, an operating mode and a relative position of a user interacting with the first computing device.

15. The system for encoding a sound field of claim 14, where a sensor that provides the sensor reading comprises one or more of a magnetometer, an accelerometer, a proximity sensor, a gravity sensor, a gyroscope and a rotational vector sensor.

16. The system for encoding a sound field of claim 14, where the active component comprises one or more of a front facing camera, a back facing camera or a remote camera.

17. The system for encoding a sound field of claim 14, where the operating mode comprises one or more of a software application and an orientation lock setting.

18. The system for encoding a sound field of claim 13, where the sound field comprises a spatial representation of an audible environment associated with the first computing device.

19. The system for encoding a sound field of claim 13, where encoding the sound field comprises processing audio signals received by the selected microphones and associating descriptive information with the audio signals.

20. The system for encoding a sound field claim 19, where the descriptive information associated with the selected microphones comprises any one or more of a number of selected microphones, a physical location of the selected microphones, a device identification number and video synchronization information.

21. The system for encoding a sound field of claim 19, where the microphone selector is further configured to select the one or more microphones from two microphones associated with a stereo sound field.

22. The system for encoding a sound field of claim 19, where select one or more microphones comprises selecting three or more microphones associated with a multichannel sound field.

23. The system for encoding a sound field of claim 19, where processing the audio signals received by the selected microphones comprises mixing the audio signals to produce fewer audio signals representing fewer selected microphones.

24. The system for encoding a sound field of claim 13, where the orientation detector is configured to detect one or more indications of a change in the orientation of the first computing device;

the microphone selector is configured to select one or more microphones associated with the first computing device responsive to the indications of the change in the orientation of the first computing device; and the system further comprises:

a mixer to apply variable ratio mixing when encoding the sound field received by the selected microphones responsive to the indications of the change in the orientation of the first computing device.

* * * * *